US005357578A

United States Patent [19]

Taniishi

[11] Patent Number: 5,357,578

[45] Date of Patent: Oct. 18, 1994

[54] ACOUSTIC OUTPUT DEVICE, AND ELECTRONIC APPARATUS USING THE ACOUSTIC OUTPUT DEVICE

[75] Inventor: Shinnosuke Taniishi, Kawasaki, Japan

[73] Assignee: Canon Kabushiki Kaisha, Tokyo, Japan

[21] Appl. No.: 155,137

[22] Filed: Nov. 22, 1993

[30] Foreign Application Priority Data

Nov. 24, 1992 [JP] Japan ..... 4-313317
Jan. 19, 1993 [JP] Japan ..... 5-006973

[51] Int. Cl.[5] ..... H04R 25/00

[52] U.S. Cl. ..... 381/158; 381/190; 310/324

[58] Field of Search ..... 381/190, 173, 158, 98, 381/61, 79, 196, 203, 114; 340/384 E; 310/324, 800, 327, 334

[56] References Cited

U.S. PATENT DOCUMENTS 1,616,639 2/1927 Sprague ..... 381/79
4,593,160 6/1986 Nakamura ..... 310/324

*Primary Examiner*—Curtis Kuntz
*Assistant Examiner*—Huyen D. Le
*Attorney, Agent, or Firm*—Fitzpatrick, Cella, Harper & Scinto

[57] ABSTRACT

Sound waves from a plate-shaped acoustic source, which generates fundamental waves (sound waves) having at least two frequencies, propagate through a propagating portion. The propagating portion consists of a medium in which a non-linear interaction is induced by the fundamental waves. A secondary sound wave having a frequency conforming to the difference between the two fundamental waves is generated by the medium. Fundamental wave components other than the secondary sound wave are absorbed by an acoustic absorber so that only the secondary sound wave is delivered as an output. The acoustic source, propagating portion and acoustic absorber are substantially transparent and stacked in three layers. This allows the resulting acoustic output device to be incorporated in the display unit of an electronic apparatus.

17 Claims, 6 Drawing Sheets

ACOUSTIC OUTPUT DEVICE, AND ELECTRONIC APPARATUS USING THE ACOUSTIC OUTPUT DEVICE

BACKGROUND OF THE INVENTION

1. Field of the Invention

This invention relates to an acoustic output device having ultradirectivity, as well as an electronic apparatus using this device. More particularly, the invention relates to an acoustic output device for realizing a man-machine interface by sound waves, as well as an electronic apparatus using the device.

2. Description of the Related Art

An electronic apparatus is known in which various indications and messages are provided as outputs not only by an indicator such as a display but also in the form of audio. However, when an electronic apparatus of this kind is used in an office or the like, the audio is an annoyance to those in the vicinity and therefore the operator is required to use a headphone or earphone.

When the headphone or earphone is used, however, the operator cannot hear other sounds, such as the ringing of a telephone. In addition, wearing a headphone at all times is bothersome and does not allow good operability.

SUMMARY OF THE INVENTION

An object of the present invention is to provide a compact, ultradirective acoustic output device and an electronic apparatus using the same, wherein the device is capable of realizing an acoustic man-machine interface without requiring the use of an earphone or the like and without annoying individuals in the vicinity.

Another object of the present invention is to provide an acoustic output device having a very high directivity.

Still another object of the present invention is to provide an acoustic output device capable of being made very thin so as to fit compactly in an electronic apparatus.

A further object of the present invention is to provide an acoustic output device capable of being integrated with an information device without resulting in an information device of large size, wherein it is possible to realize the ultradirectivity possessed by a parametric speaker.

Yet another object of the present invention is to provide an electronic apparatus having an interface in which the apparatus and an acoustic output device exhibiting ultradirectivity are combined so that only the operator can hear an emitted sound and not other individuals in the vicinity.

Another object of the present invention is to provide an electronic apparatus in which a more user-friendly man-machine interface is realized, wherein the operator need no longer be bothered with use of an earphone or the like as in the prior art.

A further object of the present invention is to provide an electronic apparatus having an acoustic interface in which a speaker portion is constructed using a transparent member, thereby making it possible to use the speaker portion by incorporating it in the display of the electronic apparatus, wherein sound is capable of being transmitted solely to the operator so as not to disturb others by unnecessary sounds.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENTS

Before giving a detailed described of preferred embodiments of the invention with reference to the accompanying drawings, the construction and principles of a parametric speaker employed in the invention will be described in accordance with FIG. 2.

Figure 2:
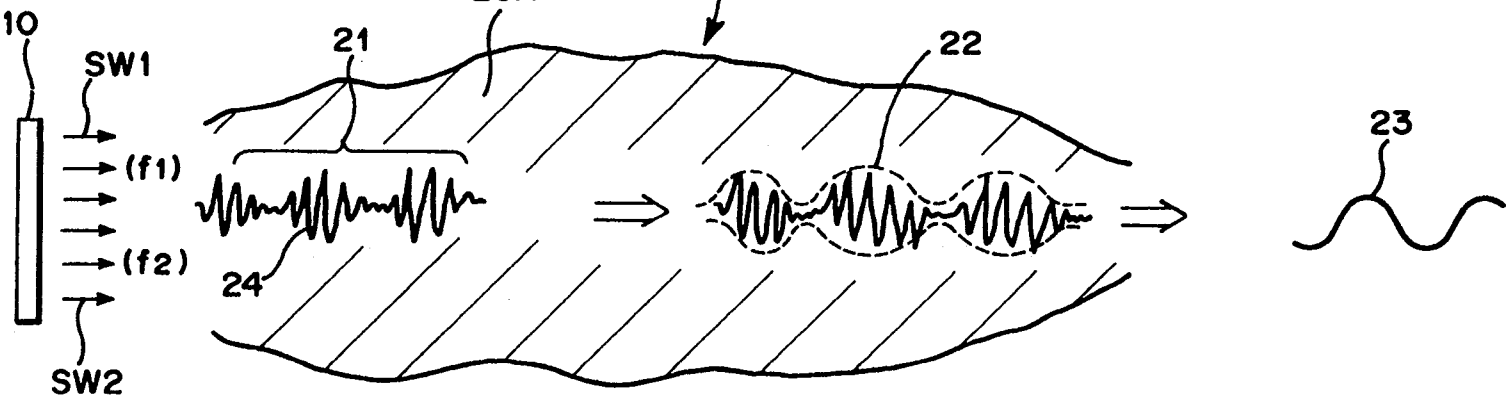
FIG. 2 is a diagram for describing the principles of the speaker according to this embodiment.

When two sound waves SW1 and SW2 having different frequencies $f_1$ and $f_2$, respectively, are emitted by an acoustic source 10 toward a specific propagating medium, as shown in FIG. 2, the two sound waves SW1 and SW2 interfere with each other to produce so-called beats 21, in which the amplitude varies periodically. The frequency of the resultant carrier wave is $(f_1+f_2)/2$, and the frequency of the amplitude-modulated wave 22 corresponding to the beats is represented by $(f_1-f_2)/2$ (where $f_1>f_2$) If the waveforms of the two sound waves SW1 and SW2 both have sufficiently large amplitudes, the resultant secondary waveform of FIG. 2 will gradually become distorted, as indicated by a secondary-wave acoustic source area 20, until it is finally extinguished while a sound wave (hereinafter referred to as a difference tone) 23 having a frequency corresponding to $(f_1-f_2)$ is produced.

This phenomenon arises owing to a non-linear interaction induced by the non-linear substance of a medium 20A, which forms the secondary-wave acoustic source area 20, while the two large-amplitude sound waves SW1 and SW2 emitted by the acoustic source 10 propagate through the medium 20A. Thus, the medium 20A (the secondary-wave acoustic source area 20) serves as a virtual acoustic source that produces the difference tone 23 whose frequency corresponds to the difference between the frequencies $f_1$ and $f_2$. Let the sound waves SW1 and SW2 be referred to as primary waves and let the difference tone 23 be referred to as a secondary wave. As long as the influence of the aforementioned non-linear interaction continues between the primary waves SW1 and SW2, the secondary-wave acoustic source area 20 will function as the virtual acoustic source of the difference tone 23 until the amplitudes of the primary waves SW1 and SW2 attenuate to linear wave motion having an infinitely small amplitude. More specifically, the virtual acoustic source of a very long propagation distance, or in other words, a series of waveforms having a very long propagation distance, is formed in the medium 20A. Therefore, even if the frequency of the difference tone 23 is low, a very high directivity will be obtained.

Figure 1:
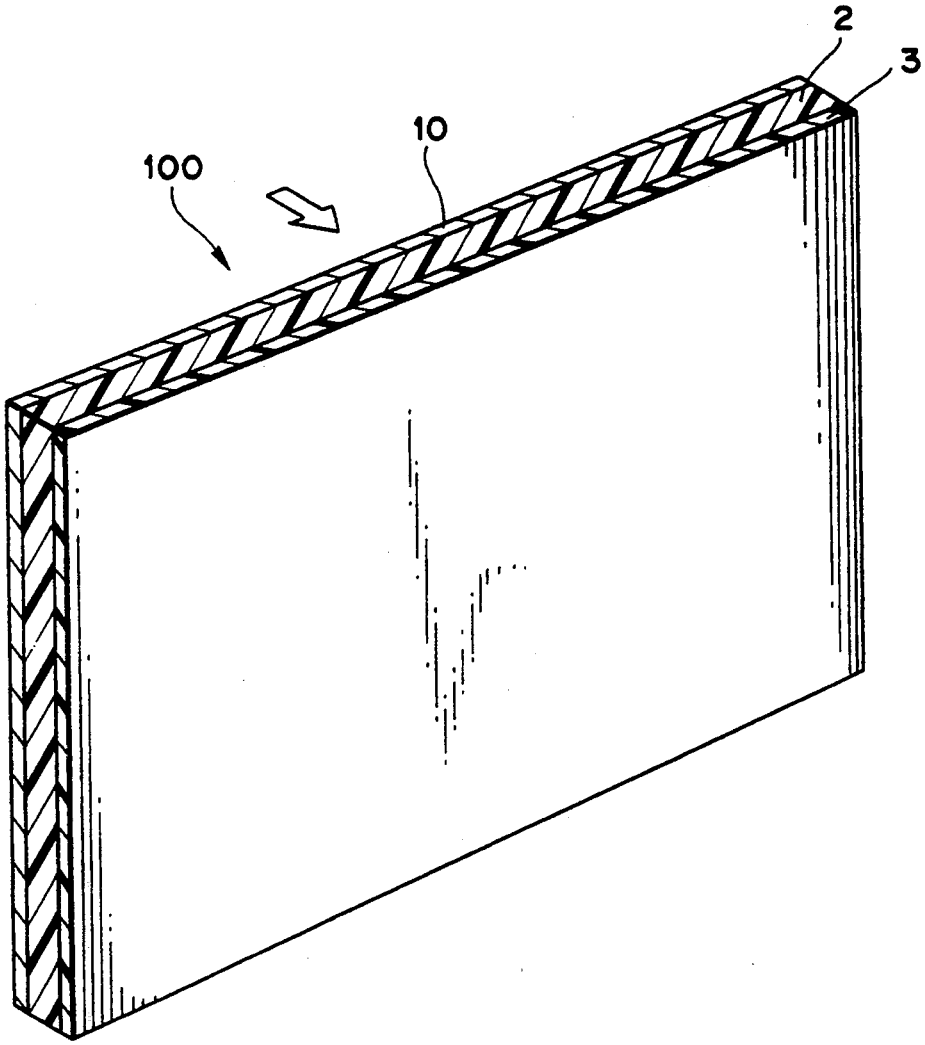
FIG. 1 is an external perspective view showing the construction of a speaker according to a first embodiment of the present invention.

FIG. 1 is an external perspective view showing an acoustic output unit (a speaker) 100 according to a first embodiment of the present invention to which the above-described principles are applied. Numeral 10 denotes the acoustic source, which is formed as a flat plate, for generating sound waves having a plurality of different frequencies. Numeral 2 denotes an area (referred to as a propagating portion hereinafter) corresponding to the secondary-wave acoustic source area 20 (medium 20A) for bringing about the above-mentioned non-linear interaction between the sound waves emitted by the acoustic source 10. Numeral 3 denotes an acoustic absorber that absorbs the primary waves (SW1, SW2), in the sound waves emitted by the acoustic source 10, that do not contribute to generation of the secondary wave.

The acoustic source 10 is formed from a transparent piezoelectric material such as polyvinylidene fluoride resin (PVDF) copolymer. Further, with regard to the propagating portion 2, an ideal material for the medium is a material such as transparent silicone gel having such a characteristic that induces the non-linear interaction with respect to sound waves. Furthermore, the acoustic absorber 3 can be formed from a material such as transparent acrylic resin having such a characteristic that the primary waves can be absorbed sufficiently.

In FIG. 1, the direction of the arrow indicates the direction in which the sound waves propagate as well as the direction of elongation of the propagating portion 2, which consists of an aromatic polyester or the like. The primary sound waves corresponding to the frequencies $f_1$ and $f_2$ are emitted by the acoustic source 10. The difference $(f_1-f_2)$ between these frequencies is set to the audible region. For example, if $f_1$ is set to 50 KHz and $f_2$ to 45 KHz, the secondary wave $(f_1-f_2)$ will be 5' KHz. When the sound wave of a primary wave is emitted by the acoustic source 10, the primary wave basically propagates through the propagating portion 2 while maintaining a spread of 360° . At this time, a primary wave remaining within the propagating portion 2 without contributing to generation of the secondary wave of the difference tone 23 is absorbed by the acoustic absorber 3. Accordingly, superfluous sound will not propagate externally of the acoustic absorber 3.

The propagation characteristic of the propagating portion 2 (medium 20A) in the acoustic output unit 100 according to this embodiment will now be described in greater detail.

In order to readily bring about the non-linear interaction between the primary waves in the propagating portion 2, the latter is made of an aromatic polyester. The latter uses a monomer such as aromatic diol, aromatic dicarboxylic acid or hydroxy-carboxylic acid as a methogen radical. It is known that the anisotropy of the elastic constant of aromatic polyester becomes greater in the direction of elongation owing to the stretching of the polyester. This means that the velocity at which sound propagates rises sharply in the direction of elongation. Further, owing to the higher velocity of propagation of sound waves in the propagating portion 2, the waveforms of the sound waves themselves are readily distorted, as a result of which the non-linear interaction readily occurs. It should be noted that the same effect can be obtained even if a material such as PE (polyethylene) or (PVDF) polyvinylidene fluoride resin is employed instead of the aromatic polyester.

Figure 3:
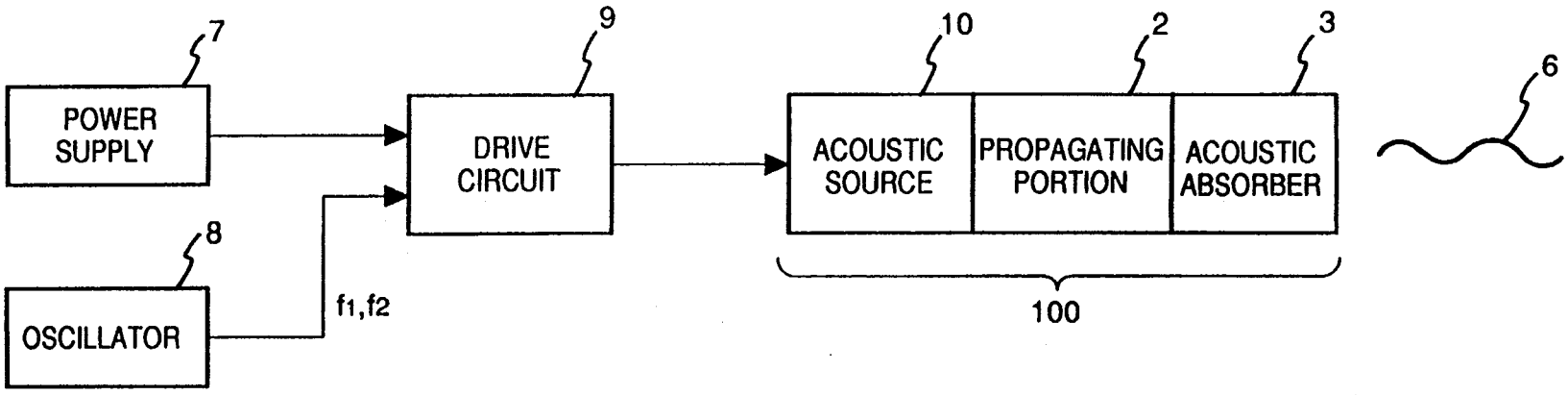
FIG. 3 is a block diagram showing the construction of a speaker and its drive unit according to this embodiment.

FIG. 3 is a block diagram showing the construction of the parametric speaker 100 and its drive unit according to this embodiment. Portions identical with those shown in FIG. 1 are designated by like reference numerals and need not be described again in detail.

In FIG. 3, numeral 7 denotes a power supply that supplies power to drive the speaker 100. Numeral 8 denotes an oscillator for generating pulses having the frequencies $f_1$, $f_2$ that decide the frequencies of the sound waves emitted by the acoustic source 10. A drive circuit 9, which receives power from the power supply 7, is provided with the pulses from the oscillator 8 as an input signal and drives the acoustic source 10 in conformity with the frequency of the input. As a result, the acoustic source 10 issues the sound waves (primary waves) having the frequencies $f_1$, $f_2$. A sound wave 6 having a very high directivity is outputted by the speaker 100 according to this embodiment.

Figure 4B:
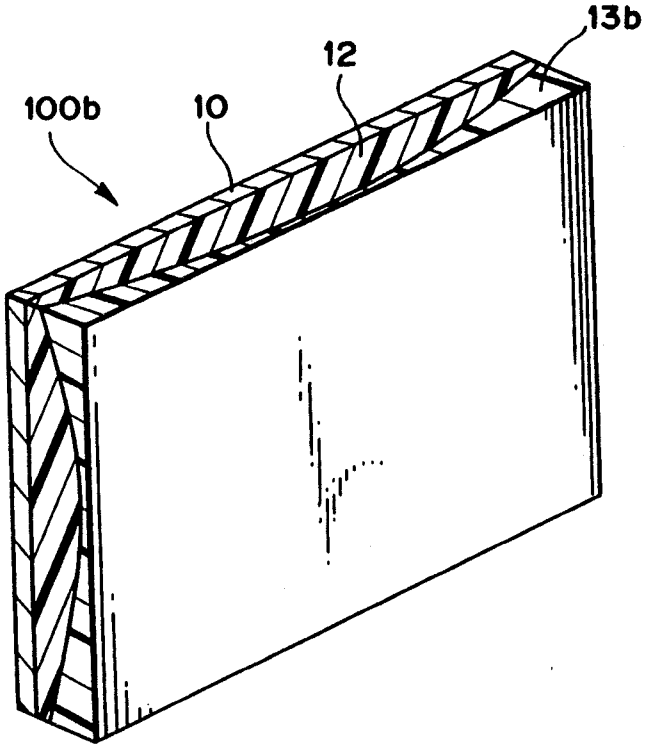
FIG. 4B is a diagram showing a modification of the speaker according to the second embodiment of the invention.
Figure 4A:
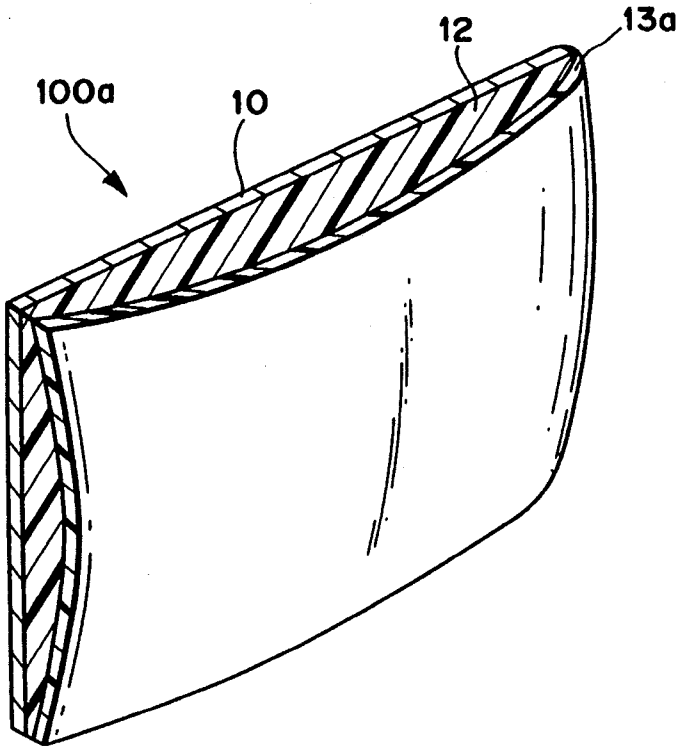
FIG. 4A is a diagram showing the construction of a speaker according to a second embodiment of the invention.

FIGS. 4A and 4B are diagrams showing the construction of acoustic output units **100*a*, 110*b*, respectively, according to a second embodiment of the invention. Numeral 12 in FIGS. 4A and 4B denotes a propagating portion. In both cases the propagating portion 12 is formed to have the shape of a convex lens. More specifically, the central part of the propagating portion 12 on the side of an acoustic absorber (13*a* in FIG. 4A and 13*b* in FIG. 4B) is formed to have a smooth projecting portion defining the shape of a convex lens. As a result, sounds wave which propagate within the propagating portion 12 are emitted while being concentrated in the central part thereof in a highly efficient manner. It should be noted that the acoustic absorber 13*a* may be formed to cover the propagating portion 12 with a uniform thickness, as shown in FIG. 4A. Alternatively, the acoustic absorber 13*b* shown in FIG. 4B** may be adopted, in which the outer surface thereof is formed to be flat.

Figure 5:
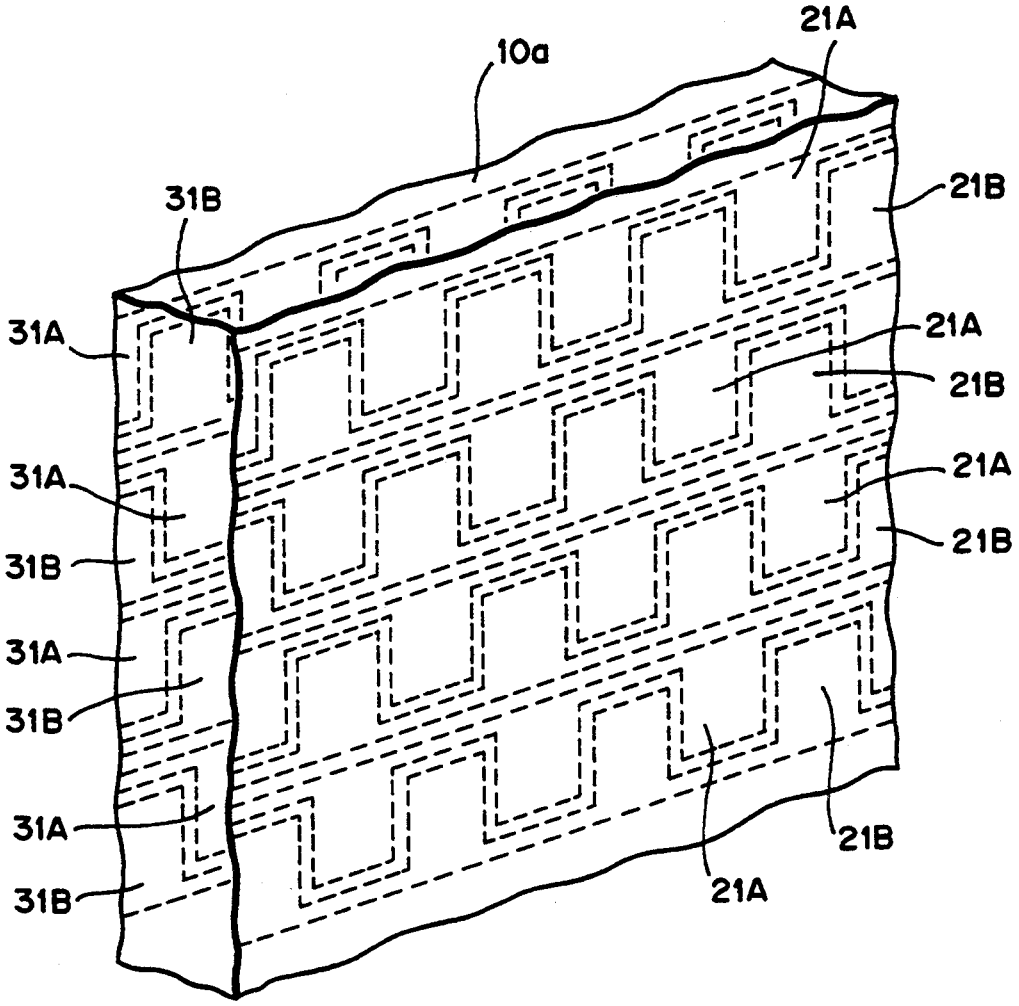
FIG. 5 is a perspective view schematically showing the construction of an acoustic source according to a third embodiment.

FIG. 5 is a perspective view schematically showing the construction of an acoustic source **10*a*** according to a third embodiment of the invention.

In this embodiment, the acoustic source **10*a* is formed in its entirety from a material such as PVDF copolymer exhibiting transparency and a piezoelectric property. One face of the acoustic source 10*a* is provided with positive electrodes in staggered fashion, and the other face of the acoustic source 10*a* is provided negative or ground electrodes also in staggered fashion. As a result, in the case of this embodiment, two types of sound waves having different frequencies can be produced between opposing electrodes. Specifically, numerals 21A, 21B denote two positive electrodes disposed in staggered fashion on one face of the acoustic source 10*a*, say the face on the side of the propagating portion (2 or 12), in such a manner as to be spaced apart a prescribed distance. Numerals 31A, 31B denote two negative electrodes disposed in staggered fashion on the other face of the acoustic source 10*a*** in the same manner.

Figure 6:
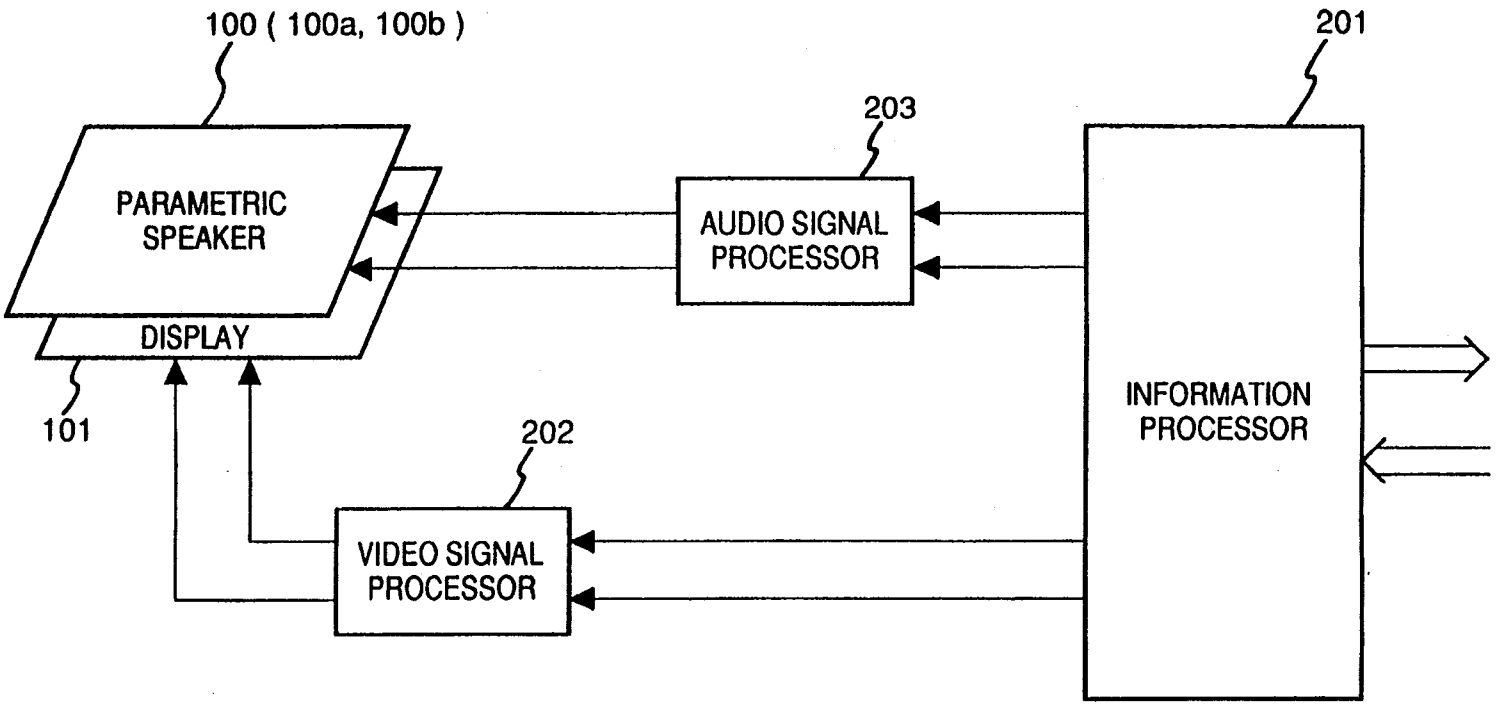
FIG. 6 is a block diagram showing an example in which a speaker according to this embodiment is incorporated in an electronic apparatus.

FIG. 6 is a block diagram showing an example in which the parametric speaker 100 (**100*a*, 100*b*) according to this embodiment is used in an electronic apparatus in combination with a display unit 101** of the electronic apparatus.

The display unit 101 in FIG. 6 is a CRT or liquid-crystal cell and is combined with the speaker 100 so as to be overlapped thereby. The speaker 100 (100*a*,100*b*) is a parametric speaker. Numeral 201 denotes an information processor for overall control of the electronic apparatus. The information processor 201 outputs an audio signal, which is delivered to the speaker 100, to an audio signal processor 203, and outputs display data, which is to be displayed on the display unit 101, to a video signal processor 202. The audio signal processor 203 drives the speaker 100 in accordance with a command from the information processor 201, thereby producing audio. The video signal processor 202 causes the display unit 101 to display various data in accordance with a signal from the information processor 201.

By adopting this arrangement, the sound or audio (audio signal) produced by the parametric speaker 100 has a very high directivity, as mentioned above, and therefore cannot be heard by anyone other than the operator who is operating the electronic apparatus while directly facing the display unit 101. Furthermore, it is possible to provide an interface based upon sound or audio that can be exchanged between the operator and the electronic apparatus, as well as an electronic apparatus having an improved man-machine interface. The distance over which the audio signal can be heard is capable of being adjusted as by a volume control (not shown) provided on the audio signal processor 203. However, it is preferred that the distance reached by the sound be approximately twice the distance over which characters or the like displayed on the display unit 101 can be read.

In the above-described embodiments, a case is set forth in which two sound waves having different frequencies are generated by the acoustic source 10 or 10*a*. However, it goes without saying that the number of fundamental frequencies is not limited to two; it is possible to produce the secondary-wave acoustic source by the non-linear interaction in the same manner using more than two frequencies, and sound waves having ultradirectivity each be outputted in space.

The present invention can be applied to a system constituted by a plurality of devices or to an apparatus comprising a single device. Furthermore, it goes without saying that the invention is applicable also to a case where the object of the invention is attained by supplying a program to a system or apparatus.

In accordance with the embodiments of the invention as described above, a speaker having a very high directivity can be provided.

Further, by combining the speaker and an electronic apparatus, it is possible to provide an interface in which only the operator can hear an emitted sound and not other individuals in the vicinity.

Moreover, since the speaker of the embodiments can be made very thin, the speaker can be fit compactly in an electronic apparatus.

Further, it is possible to realize a more user friendly man-machine interface, wherein the operator need no longer be bothered with use of an earphone or the like as in the prior art.

Further, since the speaker is constructed using a transparent member, the speaker can be used upon being incorporated in, say, the display unit of an information apparatus or the like. This makes it possible to provide an electronic apparatus having an acoustic interface in which sound is capable of being transmitted solely to the operator so as not to disturb others by unnecessary sounds. This is particularly useful in an information apparatus of the type that outputs audio.

Examples of the electronic apparatus to which the present invention applies are information processing apparatus such as personal computers and word processors, game machines, telephones and the like.

Further, the speakers (acoustic output units) described in the first through third embodiments may be employed as the acoustic output unit of the electronic apparatus according to this invention.

The acoustic source 10*a* shown in FIG. 5 can be combined with the acoustic output devices of both the first and second embodiments.

As many apparently widely different embodiments of the present invention can be made without departing from the spirit and scope thereof, it is to be understood that the invention is not limited to the specific embodiments thereof except as defined in the appended claims.

What is claimed is:

1. An acoustic output device comprising:

an acoustic source for generating sound waves having at least two different frequencies;

a sound-wave generator for propagating sound waves from said acoustic source and generating a sound wave having a frequency conforming to a difference between said different frequencies; and an acoustic absorber provided on a sound-wave output side of said sound-wave generator in order to absorb sound waves from said acoustic source.

2. The device according to claim 1, wherein said sound-wave generator is an elastomeric body of a polymeric material exhibiting structural anisotropy, said elastomeric body having an elongation direction that substantially coincides with a direction in which the sound waves propagate.

3. The device according to claim 1, wherein said acoustic source is stacked with said sound-wave generator and said acoustic absorber.

4. The device according to claim 1, wherein said acoustic source has the shape of a flat plate.

5. The device according to claim 1, wherein a boundary surface at which said sound-wave generator and said acoustic absorber are stacked is formed to be a convex surface with respect to said acoustic source.

6. The device according to claim 5, wherein said acoustic absorber has a substantially uniform thickness.

7. The device according to claim 5, wherein said acoustic absorber has a thickness that conforms to said convex surface in such a manner that a surface on a side opposite said boundary surface is flat.

8. The device according to claim 1, wherein said acoustic source has both surfaces thereof provided with electrodes for generating sound waves having at least two frequencies, said electrodes each being arranged in mutually staggered fashion.

9. The device according to claim 3, wherein said acoustic source, said sound-wave generating unit and said acoustic absorber are transparent.

10. An acoustic output device for inducing a non-linear interaction by introducing two sound waves having different frequencies emitted as fundamental waves by an acoustic source, and outputting a secondary wave corresponding to a beat frequency, comprising:

a plate-shaped acoustic source for generating at least two of the fundamental waves;

a propagating portion comprising a medium in which said non-linear interaction is induced by the fundamental waves introduced from said acoustic source; and an absorber capable of absorbing fundamental wave elements other than said secondary wave formed via said propagating portion;

said acoustic source, said propagating portion and said absorber being stacked and made of transparent materials.

11. The device according to claim 10, wherein a boundary surface at which said propagating portion and said absorber are stacked is formed to be a convex surface with respect to said acoustic source.

12. The device according to claim 10, wherein said device is integrated with a display unit possessed by an electronic apparatus.

13. An electronic apparatus comprising:

a display unit having an upper surface;

an acoustic output device arranged on said upper surface and including:

an acoustic source consisting of a substantially transparent member for generating sound waves having at least two different frequencies;

a substantially transparent sound-wave generator for propagating sound waves from said acoustic source and generating a sound wave having a frequency conforming to a difference between said different frequencies; and a substantially transparent acoustic absorber provided on a sound-wave output side of said sound-wave generator in order to absorb sound waves from said acoustic source;

audio signal generating means for outputting an audio signal to said acoustic output device; and display means for displaying display data on said display unit.

14. The apparatus according to claim 13, wherein a boundary surface at which said sound-wave generator and said acoustic absorber are stacked is formed to be a convex surface with respect to said acoustic source.

15. The apparatus according to claim 14, wherein said acoustic absorber has a substantially uniform thickness.

16. The apparatus according to claim 14, wherein said acoustic absorber has a thickness that conforms to said convex surface in such a manner that a surface on a side opposite said boundary surface is flat.

17. The apparatus according to claim 13, wherein said acoustic source has both surfaces thereof provided with electrodes for generating sound waves having at least two frequencies, said electrodes each being arranged in mutually staggered fashion.

* * * * *

UNITED STATES PATENT AND TRADEMARK OFFICE

CERTIFICATE OF CORRECTION

PATENT NO. : 5,357,578

DATED : October 18, 1994

INVENTOR : SHINNOSUKE TANIISHI

It is certified that error appears in the above-identified patent and that said Letters Patent is hereby corrected as shown below:

COLUMN 2

Line 43, "$f_2$) If" should read --$f_2$). If--.

COLUMN 3

Line 43, "5′" should read --5--.

Signed and Sealed this

Second Day of May, 1995

Bruce Lehman

*Attest:*

BRUCE LEHMAN

*Attesting Officer*

*Commissioner of Patents and Trademarks*